United States Patent [19]

Neumann

[11] Patent Number: 4,753,396

[45] Date of Patent: Jun. 28, 1988

[54] VIEWER FOR AUDITING CASH REGISTER TAPES

[76] Inventor: Thomas P. Neumann, 11740 Xenon Blvd. NW., Coon Rapids, Minn. 55433

[21] Appl. No.: 7,802

[22] Filed: Jan. 28, 1987

[51] Int. Cl.[4] ..... B65H 16/08; B41J 15/04

[52] U.S. Cl. ..... 242/67.3 R; 40/347; 40/518

[58] Field of Search ..... 242/67.3 R, 67.1 R; 40/117, 347, 518; 352/129; D19/75, 89

[56] References Cited

U.S. PATENT DOCUMENTS 515,605 2/1894 McKean .
582,154 5/1897 Clapp ..... 33/164 R
585,501 6/1897 Benscoter .
721,132 2/1903 Brooks .
853,528 5/1907 Wallace .
1,499,016 6/1924 Guyton .
4,277,033 7/1981 Swenson ..... 242/67.3 R
4,469,287 9/1984 Pfister et al. ..... 242/67.3

*Primary Examiner*—Stuart S. Levy
*Assistant Examiner*—Steven du Bois
*Attorney, Agent, or Firm*—James V. Harmon

[57] ABSTRACT

A manually operated spool-to-spool winder is provided for inspecting cash register tape which includes a C-shaped framework including a flat base, an upright plate and a horizontal tape supporting plate. A pair of rotatable tape supporting spindles are journaled for rotation in the upright portion of the framework. A large serrated hand wheel is mounted on the inside of the vertical supporting plate and a relatively small knob is connected to the spindle on the outside surface of each support plate for rotating the spindles rapidly. The large diameter hand wheels facilitate slow precision advance of the tape.

3 Claims, 1 Drawing Sheet

VIEWER FOR AUDITING CASH REGISTER TAPES

PRIOR ART STATEMENT

The Examiner in charge of the present application is directed to the following references, copies of which are enclosed:

U.S. Pat. No. 4,469,287 describes an articulated cash register tape viewer having an upper table that is mounted for pivotal up-and-down movement. The base of the device is provided with a dovetail opening to receive a plate 56 having an upright portion 58 to retain the tape in place. A shaft 40 is provided causing the tape to be rewound with printed material facing inwardly, unlike the present invention. The support plate 34 extends over and covers both of the spindles 18 and 24. The present invention is much simpler in construction, makes possible advancing the tape at slow and fast speeds, winds the tape so that the printed material appears on the outside of the rewound roll and supports the spindles on an upright plate by holding the upright plate between a pair of spindle rotating members; a hand wheel and a knob.

U.S. Pat. No. 515,605 describes a reporter copy paper tablet in which paper is unwound from a roll by pulling on it manually.

U.S. Pat. No. 585,501 describes an automatic copy holder in which the reciprocation of a lever through the action of a ratchet rolls the tape on an incline from one roll to another.

U.S. Pat. No. 721,132 describes a commercial directory having a pair of vertically spaced spindles with a crank connected to one. Circular guide disks 13 are not accessible or visible when the device is in use and cannot be used for turning.

U.S. Pat. No. 853,528 describes a prescription cabinet with a pair of cranks for rolling printed material from one spindle to another.

U.S. Pat. No. 1,499,016 describes an advertising directory in which a pair of cranks are provided for winding a tape C from one roll to another. The rolls are entirely enclosed within a box which must be completely opened to mount the tape. Two-speed operation is not possible.

This invention relates to auditing devices for tapes that are wound in rolls and is particularly suitable for auditing cash register tapes.

A great many reel-to-reel winders have been provided for transferring strips of sheet material from one roll to another. There has, however, been no entire suitable device for auditing cash register tapes. To be satisfactory, such a device must be compact, simply constructed and reliable in operation as well as low in cost. It should provide a stable viewing platform for the tape, allow fast advance of the tape when moving rapidly from one portion of the tape to another as well as enabling the user to slowly and precisely advance the tape a short distance at a time when the tape is being checked line by line. In addition, it should enable the tape to be unwound from a spool onto an arbor or spool with printed material facing outwardly on both spools.

These and other more detailed and specific objectives of the invention will be apparent in view of the following specification which illustrates the invention by way of example and not by way of limitation.

THE FIGURES

Figure 1:
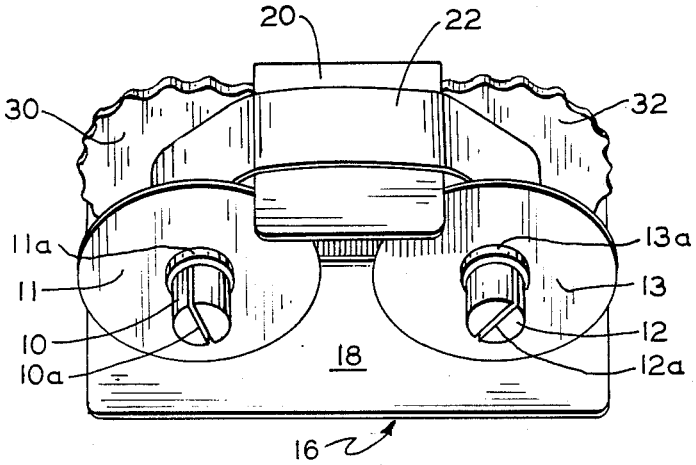
FIG. 1 is a front perspective view of the invention with cash register tape being unwound from one spindle and wound upon the other.
Figure 3:
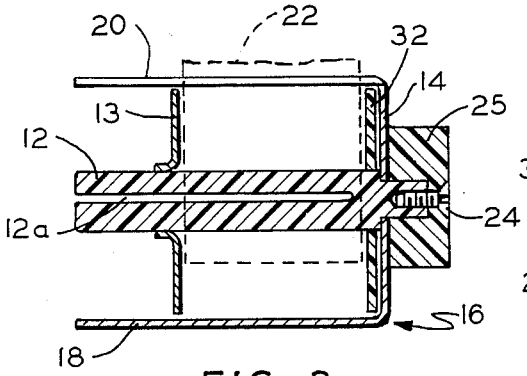
FIG. 3 is a vertical sectional view taken on line 3—3 of FIG. 2.

Referring now to the figures, numeral 16 designates generally the new viewer for auditing cash register tapes. The viewer 16 includes a generally C-shaped framework including two parallel horizontally disposed laterally extending and vertically spaced apart plates 18 and 20, the former of which serves as a base for the auditor and an upright plate 14 which is integral with plates 18 and 20. The framework 14, 18, 20 can, for example, be formed from sheet metal having right angle bends at the intersections between plates 18, 14 and 20. It will be seen that the base 18 is generally rectangular and is more than twice the size of the upper plate 20 which serves as a supporting and writing surface for the tape 22.

Figure 2:
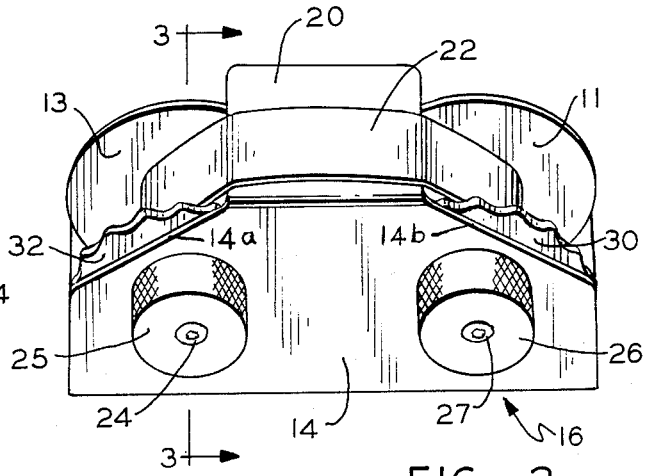
FIG. 2 is a rear perspective view of the invention.
Figure 4:
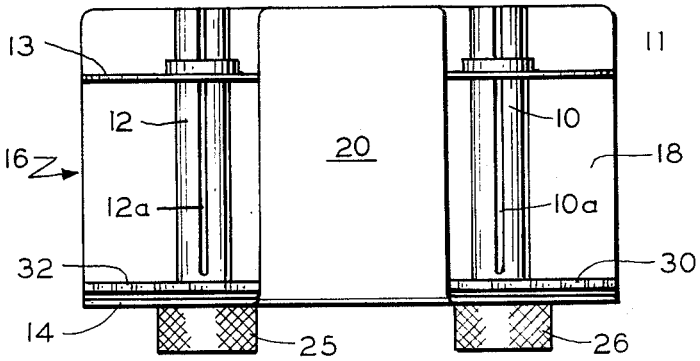
FIG. 4 is a top view of the invention with the tape removed.

Rotatably mounted in suitable bored openings in the plate 14 are a pair of horizontally extending parallel longitudinally spaced apart spindles 10 and 12, each about the same length as the width of the base plate 18 and spaced approximately intermediate the plates 18 and 20. As seen from above, the support plate 20 is located entirely between the spindles 10 and 12. The spindles 10 and 12 will rotate easily in the bored openings in the plate 14. The mating surfaces of the spindle and each of the bored openings can be smoothly polished to facilitate smooth operation, enabling the spindles to be turned easily by hand. The spindles are held in place on plate 14 by captivating the plate 14 between a pair of spindle turning members comprising circular hand wheels 30 and 32 of a relatively large size adjacent the inside surface of plate 14 and a pair of knobs 24 and 27 of a much smaller diameter adjacent the outside surface of the plate 14. The hand wheels 30 and 32 can be provided with peripheral irregularities such as serrations around their peripheral edges to make them easy to grasp with the fingers. As shown in FIG. 2, the vertical plate 14 is provided with inclined top edges **14*a* and 14*b* to expose the upper portion of the hand wheels 32 and 30 respectively. In part because of their large size and also in part because of the exposure of the top edge only by virtue of the cutaway portions of the plate 14, the hand wheels 30 and 32 make it very easy for the user to advance the tape or rewind the tape slowly and precisely so that a line-by-line check can be made. Thus, in effect, the wheels 30 and 32** serve as slow speed advancing and rewinding devices when detailed examination of the tape is necessary.

It will be seen that the knobs 24 and 27 are of a much smaller size and preferably of an appropriate size to fit easily between the thumb and forefinger so that one or both of the spindles can be twirled rapidly to advance the tape quickly, thus serving as a high speed tape advance. The hand wheels 30 and 32 can be bonded or held by friction to the spindles 12 and 14, while the knobs 25 and 26 are held in place by suitable fasteners such as screws 24 and 27. The knobs are preferably provided with high friction surfaces such as knurled surfaces as illustrated.

It can be seen that the spindles 10 and 12 are provided with central diametrically oriented longitudinally extending central slots 10*a* and 12*a* respectively. The slots have a dual purpose. They can receive the leading edge of the tape 22 when the tape is to be wound from one spindle to the other and at the same time serve as a means for frictionally holding circular retaining plates 11 and 13 on the spindles 10 and 12 respectively. As shown in FIG. 1, the retaining plates 11 and 13 are provided with collars 11*a* and 13*a* adapted to just fit over the ends of the spindles 10 and 12 when their outer ends are squeezed together slightly, this being made possible by the slots 10*a* and 12*a*, producing a friction fit.

Figure 5:
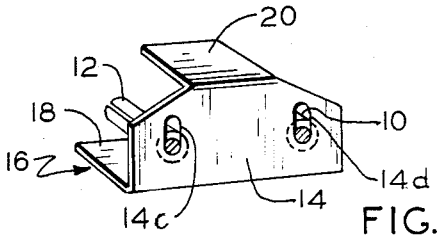
FIG. 5 is a modified form of the invention on a reduced scale.

FIG. 5 illustrates a modified form of the invention in which the bores for the spindles 10 and 12 in the plate 14 are vertically elongated rather than being circular as in the case of FIGS. 1–4. This allows the spindles 10 and 12 to move slightly in a vertical direction to thereby provide a gravitationally energized means for taking up slack at the tape. Thus, as knob 26 is turned rapidly to wind tape onto spindle 10, the spindle 12 is able to bounce up and down a short distance with the weight of the spindle taking slack and accommodating for rapid advance of the tape. This also helps the tape from binding or jamming as it is being wound or unwound.

Thus, during use, the plate 11 or 13 is removed and a spool of tape is slid onto spindle 10. The free end is placed in the slot 12*a* of spindle 12. The knob 25 is then advanced rapidly until a portion of the tape is reached which must be examined in detail to carry out the auditing operation, at which time the wheel 32 is slowly advanced manually to move the tape ahead line by line if necessary or desirable. It can be seen that the spindles 10 and 12 are both unobstructed or open at their free ends so that the cash register tape rolls can be easily slid on or off. Once the tape is wound from the spindle 10 onto the spindle 12, the printed material will be on the outside surface of the new roll. When the new roll is rewound, it will be in the condition originally provided. An important advantage of the invention is its simplicity and its ability to allow the tape to be easily wound in either direction, i.e., unrolled or rewound, that is to say, backed up, whenever desired. In addition, the device is portable, provides a secure viewing and support plate 20 for the tape 22 that serves also as a writing surface for making notes on the tape.

Thus, the invention provides an efficient tool for auditors, owners, managers, bookkeepers and others by allowing cash register tapes to be audited easily and quickly. The invention will accommodate tapes of different widths and will allow the tapes to be easily and quickly transported from one roll across the viewing plate 20 and wound into another roll.

Many variations of the present invention within the scope of the appended claims will be apparent to those skilled in the art once the principles described above are understood.

What is claimed is:

1. A manually operable spool-to-spool winder for auditing cash register tape and the like comprising a C-shaped framework formed from sheet metal and including a lower base plate adapted to rest on the surface of a desk or the like in a horizontal position, a parallel horizontally disposed tape support plate spaced vertically above the base plate and an upright plate positioned vertically and extending between the base plate and the support plate, a pair of laterally extending, horizontally disposed longitudinally spaced apart spindles aligned with the base plate and the support plate and being mounted for rotation on the upright plate, manually engageable, rotatable members connected to the spindles for enabling the spindles to be rotated bay hand, and a removable retaining member slidably engageable over a free end of each spindle to hold a roll of tape in place thereon, said spindles each having unsupported free ends permitting a roll of tape to be slipped onto the spindle and the retaining member being adapted to hold the tape on each spindle each retaining means comprising a flat plate having central openings, each opening having a smooth surface adapted to slide over one of the spindles and to rotate therewith and means for frictionally holding the retaining plates on the spindles comprising yieldable means on each spindle adapted to enable a free end of each spindle to be squeezed inwardly so as to frictionally engage the opening of the retaining plate thereon.

2. The device of claim 1 wherein the yieldable means is a longitudinal slot in each spindle adapted to enable the free end of each spindle to be squeezed inwardly.

3. A manually operated spindle-to-spindle winder for auditing cash register tape comprising, a supporting framework having a base and vertically disposed upright plate element, a pair of parallel laterally extending, longitudinally spaced apart spindles rotatably mounted upon the vertical plate for free and independent rotation therein, said winder including a horizontally disposed laterally extending flat tape support means extending inwardly from the vertical plate above the spindles and positioned between them when viewed from above, each of the spindles having a first and second manually operable rotating means, said rotating means comprising first and second wheels captivating the vertical support plate between them and each being affixed to one of the spindles on opposite sides of the support plate, the spindles being journaled on the vertical plate with the wheel on outside thereof, one of the spindle rotating members comprising a relatively large diameter wheel located inside of the vertical plate and having an outer edge with gripping means on said outer edge, a portion of the gripping means on the outer edge of the wheel being exposed in the vicinity of the tape support means for manual engagement by projecting beyond an edge of the support plate so that a hand moving the large wheel will be in proximate relationship to tape on the support means and other portions of the gripping means on the edge of the wheel being covered by the support plate and the other spindle rotating means comprising a relatively small diameter knob located outside of the vertical plate and further away from the tape than the large wheel and being adapted to be engaged between the thumb and forefinger for rapidly spinning the spindle.

* * * * *